United States Patent [19]

Crooke

[11] 4,316,706

[45] Feb. 23, 1982

[54] VARIABLE DISPLACEMENT VANE PUMP WITH NON-FLUCTUATING FLOW

[76] Inventor: Michael D. Crooke, 120 Rathdowne St., Carlton, 3053, Victoria, Australia

[21] Appl. No.: 43,135

[22] Filed: May 29, 1979

[30] Foreign Application Priority Data

Jun. 1, 1978 [AU] Australia ..... PD4579

[51] Int. Cl.[3] ..... F04C 2/00; F04C 15/02

[52] U.S. Cl. ..... 418/16

[58] Field of Search ..... 418/16, 30, 159, 24–27

[56] References Cited

U.S. PATENT DOCUMENTS

| | | | |
|---|---|---|---|
| 2,206,384 | 7/1940 | Adler | 418/16 |
| 2,612,110 | 9/1952 | Delegard | 418/16 |
| 2,921,535 | 1/1960 | Welch | 418/159 |
| 3,120,814 | 2/1964 | Mueller | 418/159 |
| 3,717,423 | 2/1973 | Pedersen et al. | 418/16 |
| 3,744,939 | 7/1973 | Grennan et al. | 418/30 |

FOREIGN PATENT DOCUMENTS

| | | | |
|---|---|---|---|
| 988511 | 5/1951 | France | 418/16 |

*Primary Examiner*—John J. Vrablik

*Attorney, Agent, or Firm*—Scully, Scott, Murphy & Presser

[57] ABSTRACT

A vane pump comprising vanes, a rotor carrying the vanes and which is rotatable about an axis, a housing, means defining a vane running path along which the vanes move, means defining a region of said path to be of non-constant radius relative to said axis and which varies the radius swept by the vanes as they pass along said region, an inlet port communicating with an inlet zone, an outlet port communicating with an outlet zone, a forward pumping zone between the inlet and outlet zones, a return pumping zone between the outlet and inlet zones, and means for varying the angular position of an end of one of the pumping zones in and relative to the area axially subtended by said region whereby to vary the displacement of the pump.

14 Claims, 27 Drawing Figures

VARIABLE DISPLACEMENT VANE PUMP WITH NON-FLUCTUATING FLOW

This invention relates to a vane pump.

The present invention provides a vane pump comprising vanes, a rotor carrying the vanes and which is rotatable about an axis, a housing, means defining a vane running path along which the vanes move, means defining a region of said path to be of non-constant radius relative to said axis and which varies the radius swept by the vanes as they pass along said region, an inlet port communicating with an inlet zone, an outlet port communicating with an outlet zone, a forward pumping zone between the inlet and outlet zones, a return pumping zone between the outlet and inlet zones, and means for varying the angular position of an end of one of the pumping zones in and relative to the area axially subtended by said region whereby to vary the displacement of the pump.

In the causing of said relative angular movement it is possible that said region remains static with respect to the housing and that said end moves with respect to said region. It is also possible that said end remains static with respect to the housing and that said region may move with respect to said end.

The pump may produce outputs of one of several characters.

For instance, if there is only one such region and one of each of said zones the displacement of the pump will be variable, there will be fluctuating flow and the rotor will be pressure unbalanced.

If, however, there is another such region and one of each of said zones the pump can be varied in displacement, produce non-fluctuating flow but the rotor will be pressure unbalanced. In this respect non-fluctuation of flow is best achieved by ensuring that the net of the incremental volumes displaced by a vane in one such region and a vane in the other such region is constant at all instants of time.

If, however, there is only one such region and two of each of said zones and the outlet zones are diametrically opposite about the axis the displacement of the pump can be variable, produce fluctuating flow and the rotor can be pressure balanced.

If there is another such region and two of each of said zones and the outlet zones are diametrically opposite about the axis the displacement of the pump can be variable produce non-fluctuating flow and the rotor can be pressure balanced.

It will be appreciated that any number of such regions and said zones may be provided.

Further, if desired many pumps in accordance with this invention may by variation of the displacement be made to operate in reverse such that an inlet becomes an outlet and an outlet becomes an inlet.

Preferably, said means is adapted to vary the angular position in and relative to the area axially subtended by said region of both ends of said one of the zones and wherein said ends of said one of the pumping zones subtend an angle with respect to said axis substantially equal to the angle subtended with respect to said axis by two adjacent ones of said vanes.

Preferably, in addition to said region, hereinafter called "said first region", there is a second region of said path of non-constant radius relative to said axis, and wherein the angular position of an end of another pumping zone is fixed in and relative to the area axially subtended by said second region.

Preferably, there are two or more of such first regions and two or more of such second regions and wherein a pumping zone is associated with each said first regions and said second regions.

Preferably, said means is adapted to vary the angular position in and relative to the area axially subtended by said first region of both ends of said one of the zones and wherein said ends of said one of the pumping zones subtends an angle with respect to said axis substantially equal to the angle subtended with respect to said axis by two adjacent ones of said vanes.

In one particular instance the present invention provides a vane pump comprising vanes, a rotor carrying the vanes and which is rotatable about an axis, a housing, means defining a vane running path along which the vanes move, means defining one or more first regions, and one or more second regions of said vane running path to be of non-constant radius relative to said axis and which one or more first regions and one or more second regions vary the radius swept by the vanes as they pass along said one or more first regions and said one or more second regions, an inlet port communicating with one or more inlet zones, an outlet port communicating with one or more outlet zones, one or more forward pumping zones between adjacent inlet and outlet zones, one or more return pumping zones between adjacent outlet and inlet zones, means for varying the angular position of both ends of those pumping zones that is/are in the area/areas axially subtended by said one or more first regions in and relatively to the area axially subtended by the respective first region whereby to vary the displacement of the pump, wherein both ends of those pumping zones that is/are in the area/areas axially subtended by said one or more second regions is/are fixed in and relative to the area axially subtended by the respective second region, and wherein the ends of each of the pumping zones subtend an angle with respect to said axis substantially equal to the angle subtended with respect to said axis by two adjacent ones of said vanes.

In this instance it is desirable that the non-constancy of radius of said one or more first regions and said one or more second regions are such that fluctuating displacements from the pumping zones can be combined to produce a non-fluctuating net flow for all angular positions of said both ends of these pumping zones that is/are in the area/areas axially subtended by said one or more first regions in and relative to the area axially subtended by the respective first region.

In this instance it is desirable that each of said one or more first regions has one of said one or more second regions which is so complementary thereto such that, and the non-constancy of radius of said one or more first regions and said one or more second regions are such that, fluctuating displacements from the pumping zones can be combined to produce a non-fluctuating net flow for all angular positions of said both ends of those pumping zones that is/are in the area/areas axially subtended by said one or more first regions in and relative to the area axially subtended by the respective first region.

In this instance it is desirable that each one of said one or more first regions and each one of said one or more second regions continuously increases or continuously decreases in radius.

In one instance there is one forward pumping zone in the area axially subtended by one of said one or more second regions of continuously increasing or continuously decreasing radius and one return pumping zone in the area subtended by one of said one or more first regions of, respectively, continuously increasing or continuosly decreasing radius.

In another instance there is one forward pumping zone in the area axially subtended by one of said one or more second regions of continuously increasing or continuously decreasing radius and one forward pumping zone in the area axially subtended by one of said one or more first regions of, respectively, continuously decreasing or continuously increasing radius.

In another instance there is one return pumping zone in the area axially subtended by one of said one or more second regions of continuously increasing or continuously decreasing radius and one forward pumping zone in the area axially subtended by one of said one or more first regions of, respectively, continuously increasing or continuously decreasing radius.

In another instance there is one return pumping zone in the area axially subtended by one of said one or more second regions of continuously increasing or continuously decreasing radius and one return pumping zone in the area axially subtended by one of said one or more first regions of, respectively, continuously decreasing or continuously increasing radius.

It is preferred that said one or more first regions and said one or more second regions increase or decrease in radius at least substantially in accordance with the polar co-ordinate equation:

$$\gamma^2(\theta)=k_1\theta+k_2$$

where $\gamma$ is radius, $\theta$ is angle and k, and $k_2$ are parameters which are constant for each one of said one or more first regions and each one of said one or more second regions.

Wherein the wall as described by the present invention, when swept by a vane moving with constant angular velocity, produces a flow which increases or decreases substantially linearly in relation to the angular position of the vane, as illustrated in FIG. 4.

The $\theta$ is the angle as determined by the user for his particular pump configuration. $\theta$ is 0° along an arbitrary axis, with all subsequent angular measurements relative thereto.

It is preferred that said one or more first regions and said one or more second regions increase or decrease in radius at least substantially in accordance with the polar co-ordinate equation:

$$\gamma^2(\theta)=k_1\theta+k_2$$

where $\gamma$ is radius, $\theta$ is angle and $k_1$, and $k_2$ are parameters which are constant for each one of said one or more first regions and each one of said one or more second regions and wherein for each one of said one or more first regions there is one of said one or more second regions which is so complementary thereto for which the absolute value of $k_1$ is at least substantially the same.

The constants $k_1$ and $k_2$, as defined by the afore-mentioned equation, are best understood by realizing that the equation is to define the radius $\gamma$ at any one particular point and that $k_2$ is a constant which is defining what may be considered to be the base radius of the spiral curve. For large pumps $k_2$ will be large and for small pumps $k_2$ will be small. No absolute range of values can be applied to $k_2$ but is rather dependent on the physical design of the pump. Concerning $k_1$, that constant defines the rate of change of the radius of the spiral and will be chosen in accordance with the rate of change of displacement required as each vane traverses the pumping zone associated with that spiral. No specific range of values can be given for $k_1$ as it is up to a user to determine the displacement that he wishes for his particular pump. For the pump of FIG. 23, however, it has been actually determined that the preferred value of $k_1$ is 150 $mm^2$/radian when $k_2$ is 1000 $mm^2$.

Further, on $k_1$ the basic limitations thereof are not theoretically derived but are more related to the physical dimensions allowable and desired within the general dimensional constraints of a particular pump design. In this last respect, the above value of $k_1$ has been obtained from the formula as set out below:

$$k_1 = \frac{(V\max - V\min)}{2H\pi\left(\frac{\pi}{3} - B\right)}$$

where

Vmax = maximum displacement desired ($mm^3$/revolution)

Vmin = minimum displacement desired ($mm^3$/revolution)

H = axial thickness of rotor (mm)

B = angle in radians subtended at the axis between adjacent end points of the spiral walls milled in the casing (taken at the top of the vane running surface).

In an instance it is preferred that there are two or more outlet zones arranged in radial symmetry about said axis wherein the vanes are arranged in radial symmetry about said axis and the number of vanes is an integer multiple of the number of outlet zones whereby to obtain pressure balancing of the rotor with respect to said two or more outlet zones.

In a specific embodiment the present invention provides a vane pump comprising a rotor carrying a plurality of vanes and capable of rotating about an axis, a housing for the rotor, a cavity within the housing having a cylindrical wall shaped to be of substantially constant radius to said axis between first and second angular positions, of decreasing radius to said axis between said second angular position and a third angular position and of increasing radius to said axis between said third angular position and a fourth angular position, a body located on said wall between said first and second angular positions and having an inner surface being part of an imaginary cylinder and which inner surface being of increasing radius to said axis between the end of said body adjacent said first position and an intermediate portion of said body and of decreasing radius to said axis between said intermediate portion and the end of said body adjacent said second position, inlet or outlet zones in the region of said intermediate position and in the region of said third position, outlet or inlet zones in the region of said first and second positions, and a running surface for said vanes bridging between said wall and said inner surface of said body and wherein said body is angularly moveable whereby to vary the displacement of the pump.

The fourth position and the first position are preferably one and the same although it would be possible for the wall shape as described to repeat after the fourth position one or more times to the first position.

The portions of said wall and said body of increasing and decreasing radius preferably increase and decrease at least substantially in accordance with the polar coordinate equation:

$$\gamma^2(\theta)=k_1 0+k_2$$

where $\gamma$ is radius $\theta$ is angle $k_1$ and $k_2$ are constant for each portion of said wall and said body.

In another specific embodiment the present invention provides a vane pump comprising a rotor carrying a plurality of vanes and capable of rotating about an axis, a housing for the rotor, a cavity within the housing having a cylindrical wall shaped to be of increasing radius to said axis between first and second angular positions, of decreasing radius to said axis between said second angular position and a third angular position and of substantially constant radius to said axis between said third angular position and a fourth angular position, a body located on said wall between said third and fourth angular positions and having an inner surface being part of an imaginary cylinder and which inner surface being of decreasing radius to said axis between the end of said body adjacent said third position and an intermediate portion of said body and of increasing radius to said axis between said intermediate position and the end of said body adjacent said fourth position, a running surface for said vanes bridging between said wall and said inner surface of said body; inlet or outlet zones in the region of said second position and intermediate said third and fourth positions, outlet or inlet zones in the region of said third and fourth positions, and wherein said body is angularly moveable whereby to vary the displacement of the pump.

Specific examples of pumps in accordance with this invention will now be described with the aid of the accompanying drawings in which:

FIG. 1 is a schematic end elevational view of the pumps to be described below, FIG. 2 is a schematic cross-sectional view of a first pump in accordance with this invention, the section being on line x—x in FIG. 1, FIG. 3 is a developed view of the first pump in various adjustments, FIG. 4 is a graph showing the displacement (D) of the first pump with respect to time (T), FIG. 5 is a schematic cross-sectional view of a second pump in accordance with this invention, the section being on line x—x in FIG. 1, FIG. 6 is a developed view of the second pump in various adjustments, FIG. 7 is a graph showing the displacement (D) of the second pump with respect to time (T), FIG. 8 is a schematic cross-sectional view of a third pump in accordance with this invention, the section being on line x—x in FIG. 1, FIG. 9 is a developed view of the third pump in various adjustments, FIG. 10 is a graph showing the displacement (D) of the third pump with respect to time (T), FIG. 11 is a schematic cross-sectional view of a fourth pump in accordance with this invention, the section being on line x—x in FIG. 1, FIG. 12 is a developed view of the fourth pump in various adjustments, FIG. 13 is a graph showing the displacement (D) of the fourth pump with respect to time (T), FIG. 14 is a schematic cross-sectional view of a first variant on the fourth pump in accordance with this invention, the section being on line x—x in FIG. 1, FIG. 15 is a schematic cross-sectional view of a second variant on the fourth pump in accordance with this invention, the section being on line x—x in FIG. 1, FIG. 16 is a schematic cross-sectional view of a third variant on the fourth pump in accordance with this invention, the section being on line x—x in FIG. 1, and is a mirror image of the fourth pump, FIG. 17 is a schematic cross-sectional view of a fifth pump in accordance with this invention, the section being on line x—x in FIG. 1, FIG. 17*b* shows a part, FIG. 18 is a developed view of the fifth pump in various adjustments, FIG. 19 is a graph showing the displacement (D) of the fifth pump with respect to time (T), FIG. 20 is a schematic cross-sectional view of a sixth pump in accordance with this invention, the section being on line x—x in FIG. 1, FIG. 21 is a developed view of the sixth pump in various adjustments.

Figure 1:
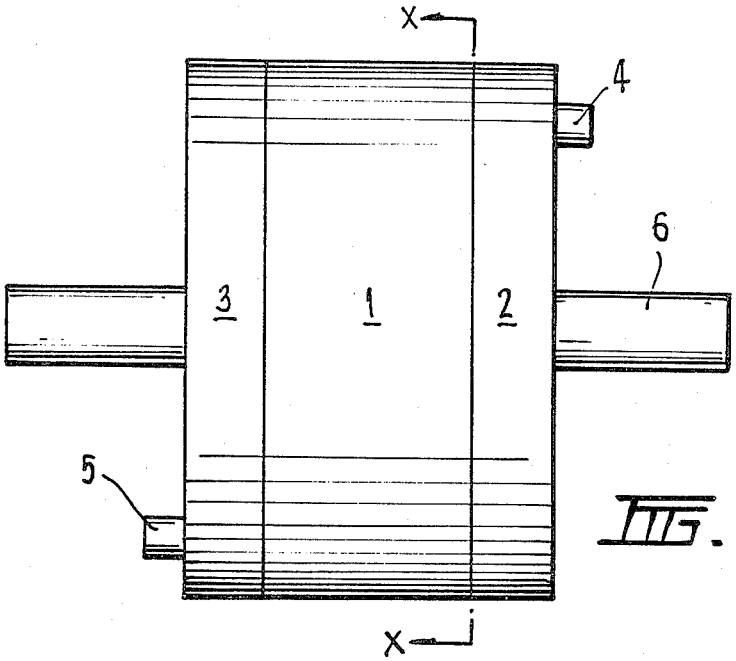

The pump shown in FIG. 1 has a housing comprised of a main casing 1, end plates 2 and 3 having ports 4 and 5 and a drive shaft 6. All of the pumps described below have these common features.

One or more end plates may serve in part to define inlet and outlet zones which communicate with the ports 4 and 5.

In the cross-sectional views described below the end plates are omitted but inlet and outlet and outlet zones are shown by dot and dash lines in their positions.

For the sake of convenience it may be useful to define various zones which are present in the pumps.

An inlet zone or an outlet zone is a zone through which vanes pass such that a vane in an inlet zone has both sides thereof in fluid communication with an inlet port and a vane in an outlet zone has both sides thereof in fluid communication with an outlet port.

A pumping zone is a zone through which vanes pass such that a vane in a pumping zone has one side thereof in fluid communication with an outlet zone and the other side thereof is sealed from said one side and is in fluid communication with an inlet zone.

In the case of a forward pumping zone the leading and trailing sides of a vane passing therethrough respectively communicate with an outlet and an inlet zone. In the case of a return pumping zone, the leading and trailing sides of a vane passing therethrough respectively communicate with an inlet and an outlet zone.

Figure 2:
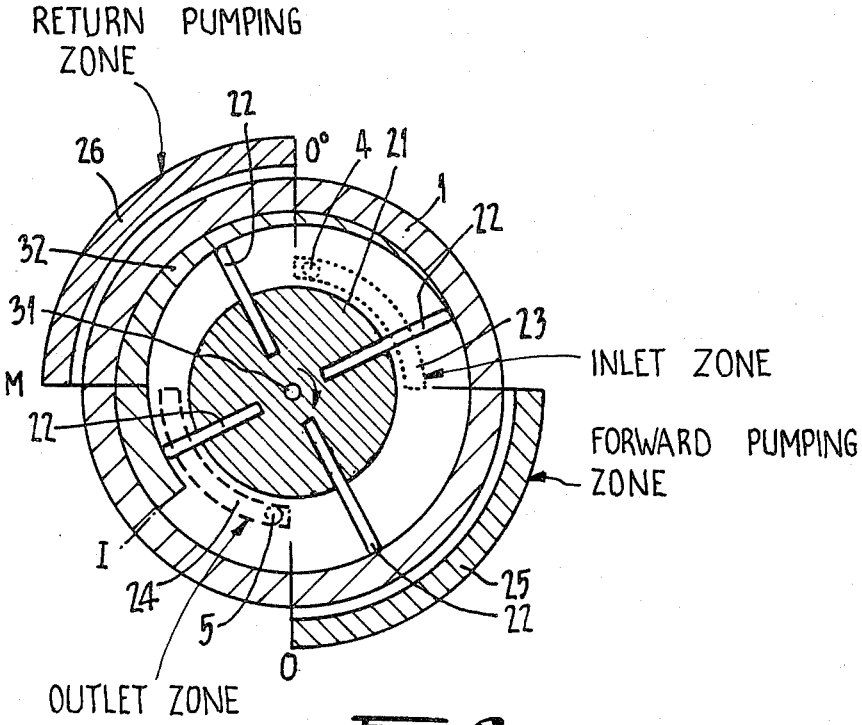
Figure 3A:
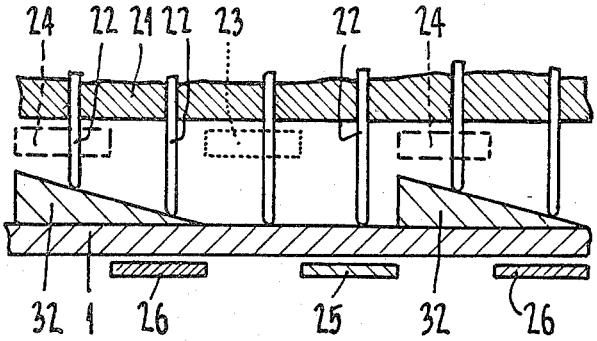
Figure 4A:
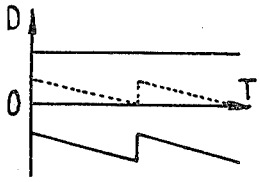
Figure 3B:
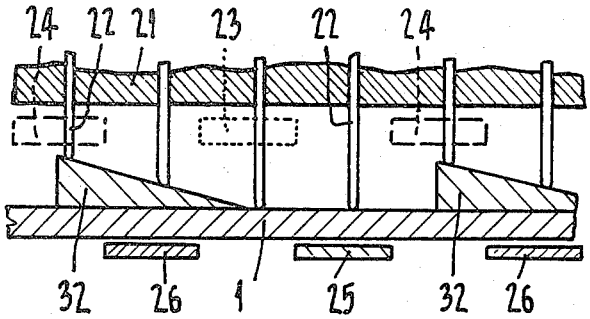
Figure 4B:
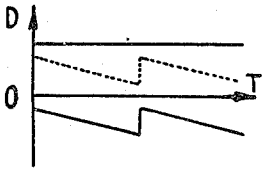
Figure 3C:
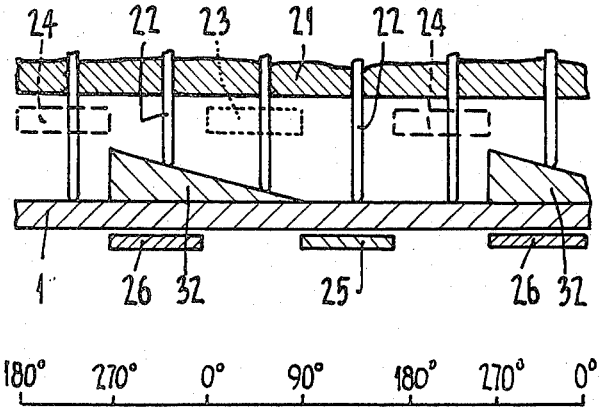
Figure 4C:
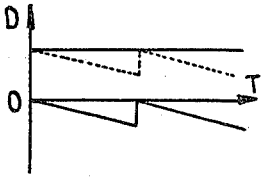

Referring now to the pump of FIG. 2, this pump has a rotor 21 provided with vanes 22, an inlet zone 23 shown by a dotted line, an outlet zone 24 shown by a dash line, a forward pumping zone 25 shown by dexter hatching and a return pumping zone 26 shown by sinister hatching. The hatchings are shown to the side of the pump for clarity. The inlet (4) and outlet (5) ports are shown.

The rotor 21 rotates about an axis 31 and rotates as shown by an arrow.

In this instance the casing 1 has an internally circular shape about the axis 31 and carries a body 32 having an inner spiral surface. The body 32 is moveable angularly with respect to the casing about axis 31.

Limits of movement of the body 32 are shown by radial lines O, I and M respectively corresponding to least, intermediate and greatest displacement with the displacement being positive when the inlet and outlet ports respectively act as inlet and outlet, and negative when the inlet and outlet ports respectively act as outlet and inlet. Between O and M displacement will vary from least (zero in some cases) to greatest. The lines O, I and M relate to one end of the body. Here the meanings of greatest and least are as in Real Number Theory.

These limits of movement are also shown by the developed view where view (a) represents the O case, (b) represents the I case and (c) represents the M case.

In the graphs showing displacement (a), (b) and (c) represent the same as above. In those graphs the lines above the zero reference line represent displacements from the inlet to the outlet (forward pumping) and those below the zero reference line represent displacements from the outlet to the inlet (return pumping). The net output is shown by a dotted line. Further, the forward pumping is to be understood to be produced by a vane in a forward pumping zone; similar applies in respect to return pumping.

As will be appreciated, relative angular movement of a pumping zone in and relative to the spiral region defined by the body 32 varies displacement. However, output flow is fluctuating and the rotor is not pressure balanced.

Note that to bridge between the least radius end of the body 32 and the casing 1 the vanes must extend less radially. This may be done by means of a vane running surface or, less feasibly, by hydraulic or other vane movers.

Figure 5:
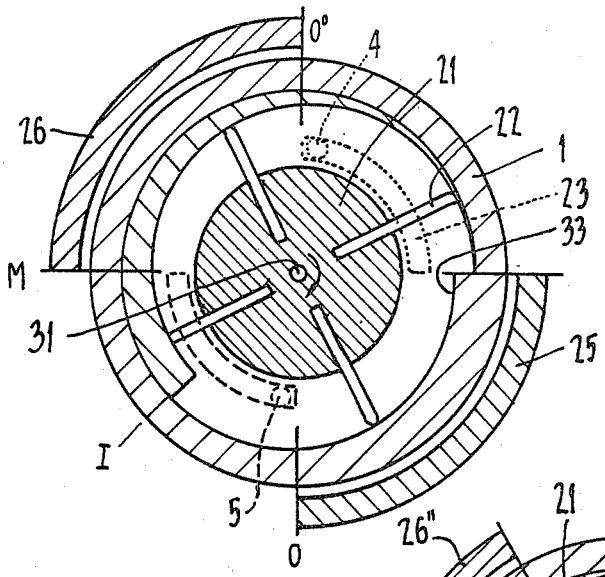

Turning now to FIG. 5, the second pump shown therein is the same as the first pump excepting in that in addition to the body 32 there is a second spiral body 33 but which is fixed in angular position with respect to the casing 1.

Figure 6A:
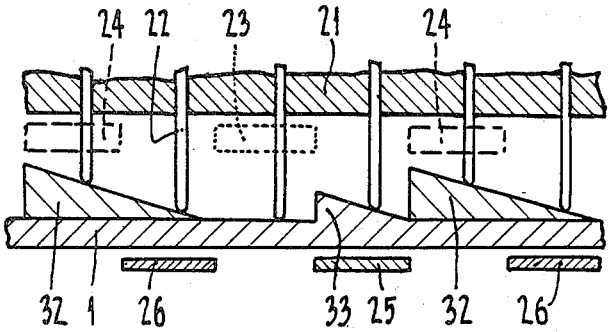
Figure 7A:
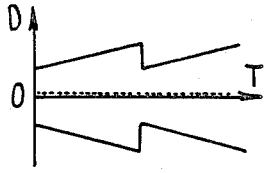
Figure 6B:
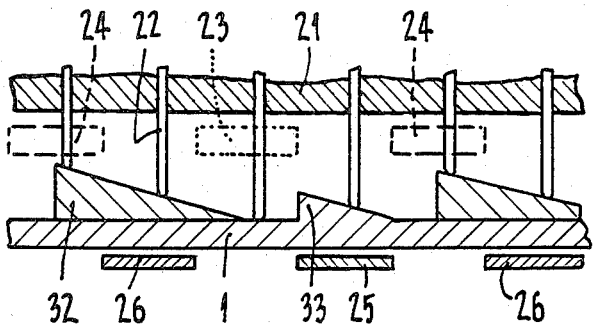
Figure 7B:
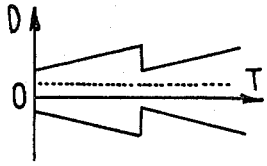
Figure 6C:
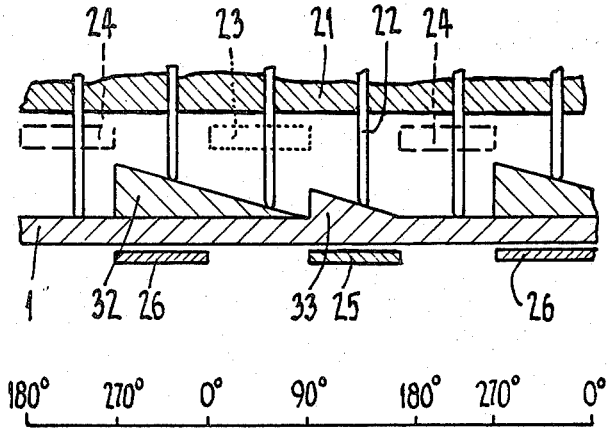
Figure 7C:
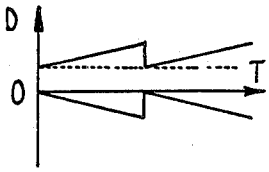

FIG. 6 shows like developed views under likesituations and FIG. 7 shows like displacement graphs excepting that it will be noted that flow is non-fluctuating but that the rotor remains not in pressure balance.

Figure 8:
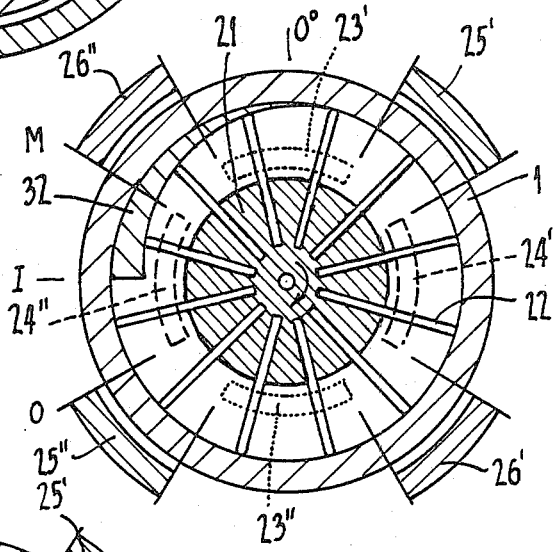

Turning now to FIG. 8, the third pump shown therein is the same as the first pump excepting that there has been a doubling of the inlet, outlet, forward and return pumping zones which are referenced as in respect of the first pump but with suffixes ′ and ″. Note that the inlet and outlet zones are diametrically opposite and are of equal angular extent. Communication between the inlet and outlet zones and with the ports 4 and 5 is achieved by ducts in the end plates 2 and 3.

Figure 9A:
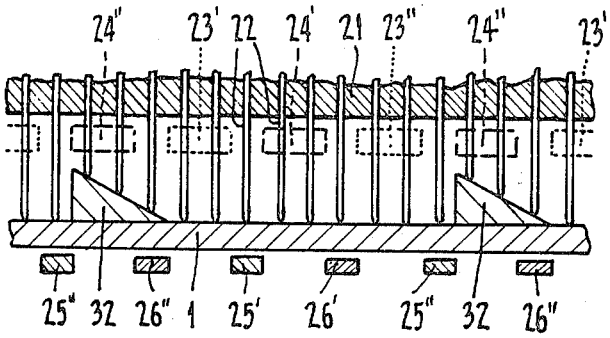
Figure 10A:
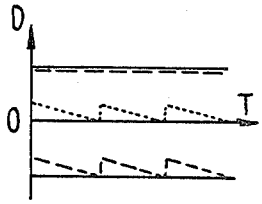
Figure 9B:
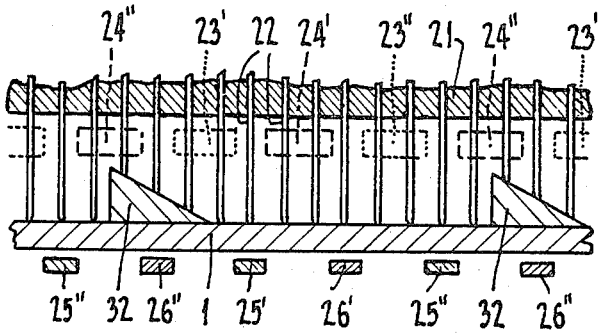
Figure 10B:
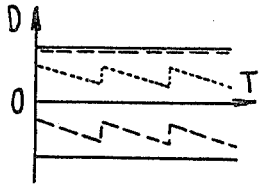
Figure 9C:
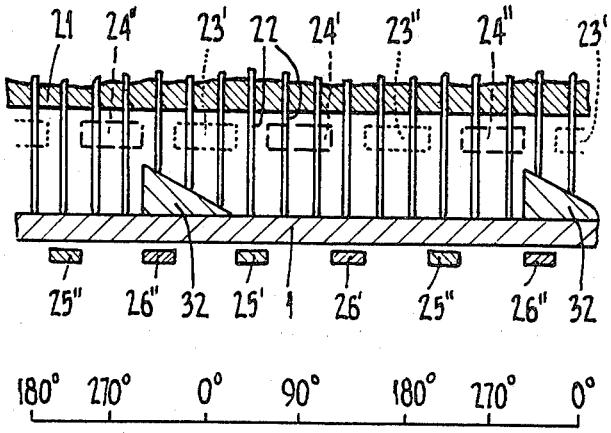
Figure 10C:
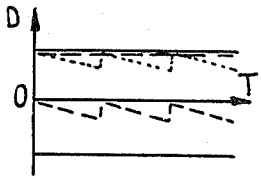

FIGS. 9 and 10 show like developed views and displacement graphs to the first pump but it will be noted in FIG. 10 that the two forward and return pumping zones above and below the zero reference are shown respectively as solid and dash lines. In this instance, there is fluctuating flow and the rotor is pressure balanced.

Figure 11:
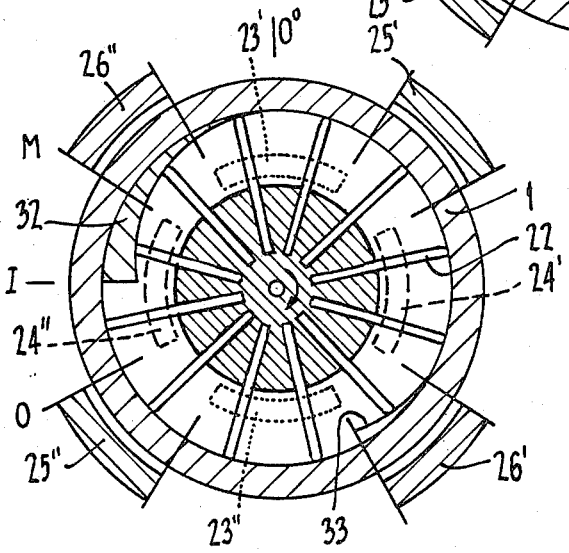
Figure 12A:
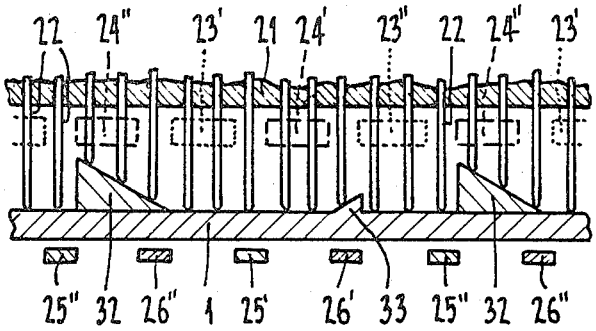
Figure 13A:
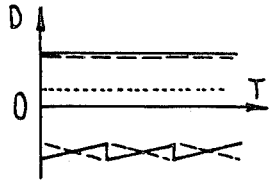
Figure 12B:
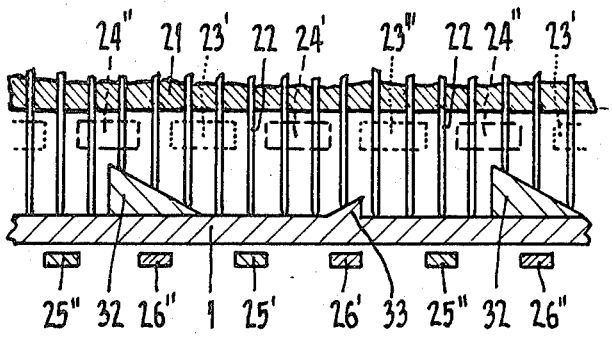
Figure 13B:
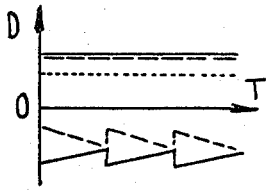
Figure 12C:
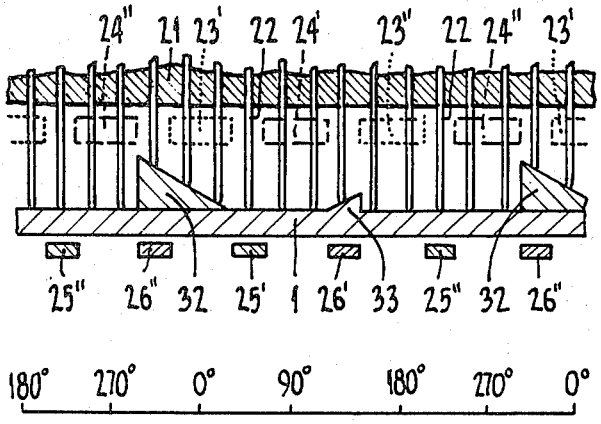
Figure 13C:
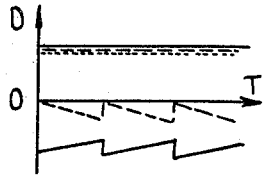

Turning now to FIG. 11, the fourth pump shown therein has the features of both the second and third pumps and FIGS. 12 and 13 show like developed views and displacement graphs which naturally are a combination of the like in respect of the second and third pumps. Thus, there is nonfluctuating flow and the rotor is pressure balanced.

Figure 14:
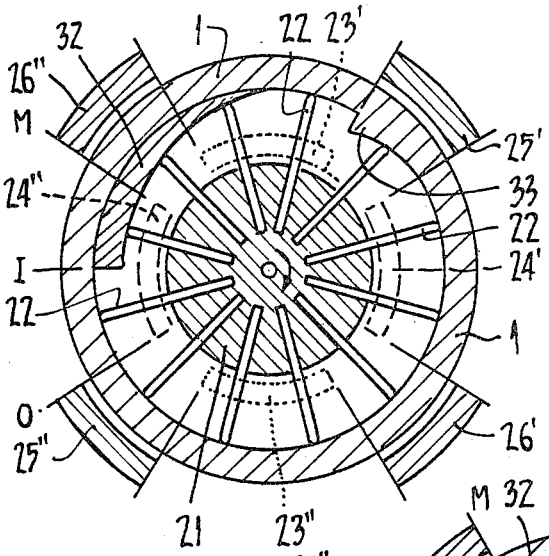
Figure 15:
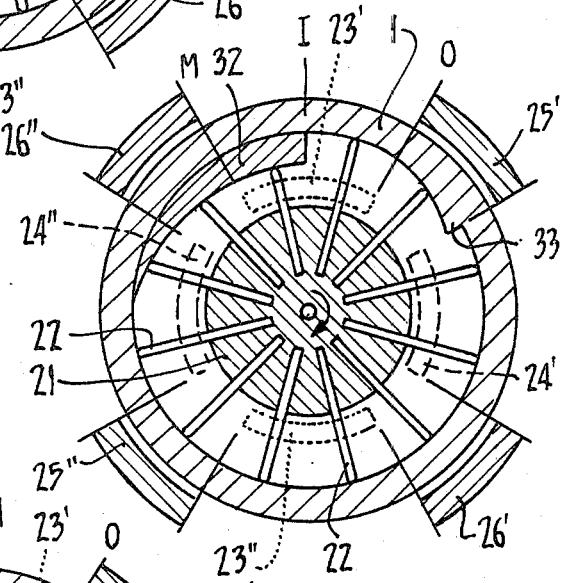
Figure 16:
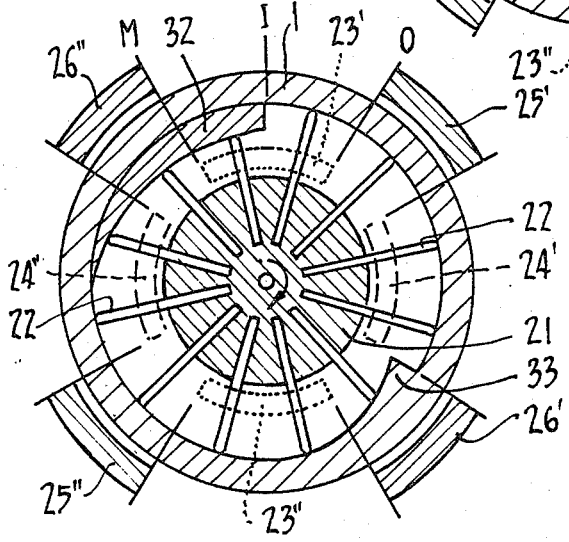

Referring briefly to FIGS. 14–16, these are variants on the fourth pump and do not require detailed description. In each instance the variant results in a pump which will produce non-fluctuating flow and will have a pressure balanced rotor.

In other modifications of the above constructions the zones themselves may be moved angularly about the axis.

Figure 17:
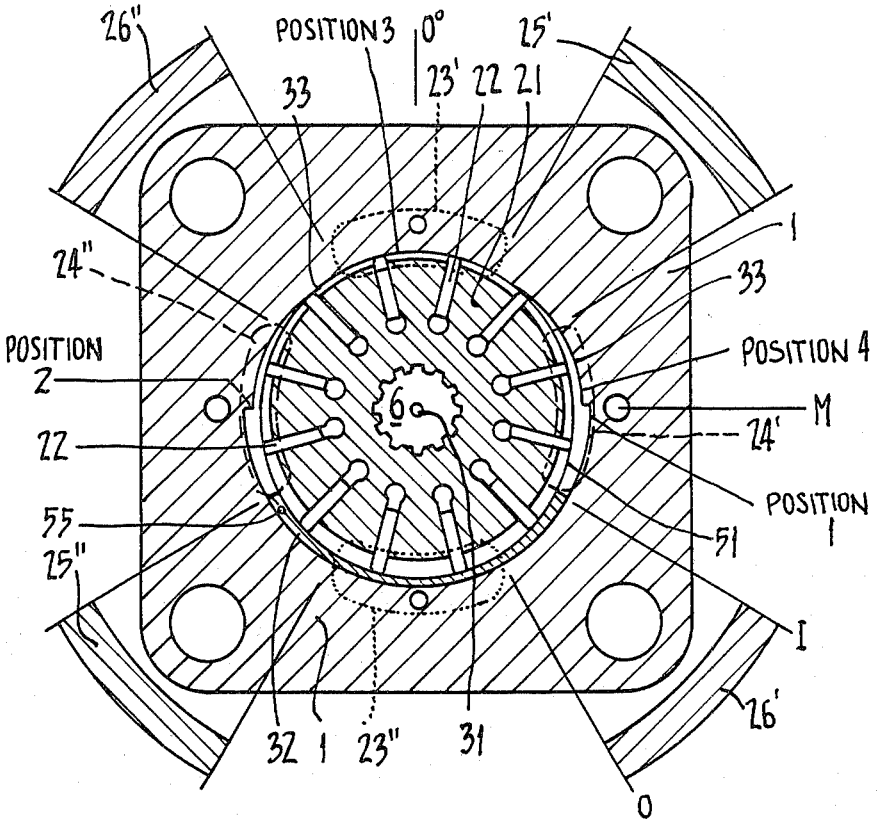
Figure 20:
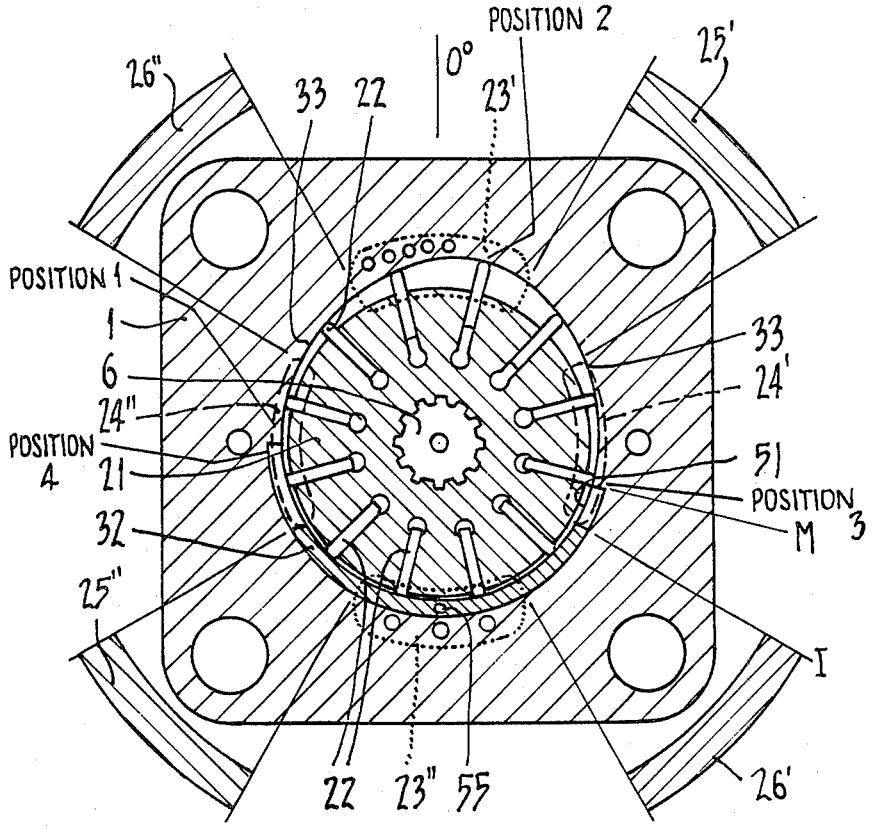
Figure 23:
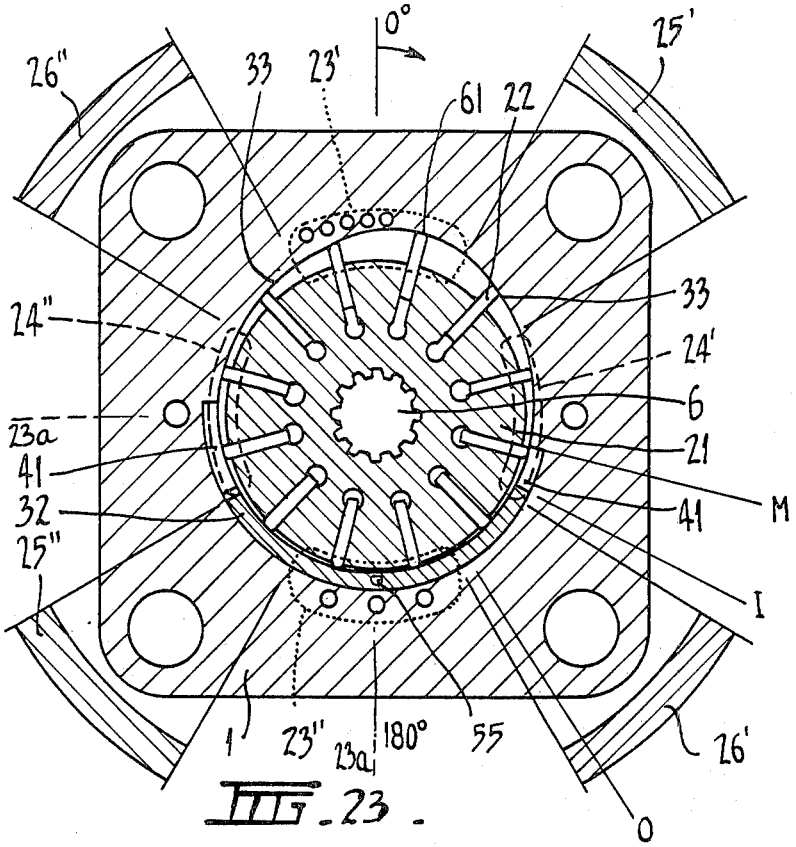
FIG. 23 is a schematic cross-sectional view of a seventh pump in accordance with this invention, being on line x—x in FIG. 1.

This last is illustrated by the fifth and sixth and seventh pumps shown in FIGS. 17, 20 and 23 and it is mentioned that pumps in accordance with the fifth, sixth and seventh pumps have been manufactured and found to operate in a satisfactory manner.

The fifth pump shown in FIG. 17 is similar to the fourth pump but it is to be noted that in this instance the inlet and outlet 4 and 5 communicate with the inside of the casing 1 through the casing 1 radially of axis 31 rather than merely through the end plates 2 and 3. Further, the body 32 has a vane running 51 surface secured thereto to rotate about axis 31 with the body 32. Means for moving the body 32 is not shown but may include any convenient mechanism.

The vane running surface 51 has ports 52′ and 52″ (shown in FIG. 17*b*) which effectively define inlet zones and ports 53′ and 53″ which effectively define outlet zones. As the vane running surface is itself moveable about the axis 31, the inlet and outlet zones and the pumping zones intermediate the inlet and outlet zones are made moveable about axis 31. The one position of those zones is shown in FIG. 17 and limits of movement of these zones is also shown in FIG. 17.

Figure 18A:
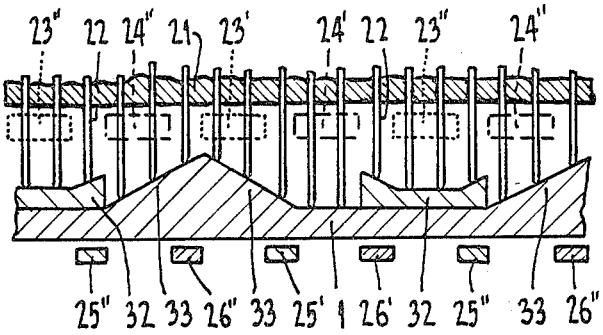
Figure 18B:
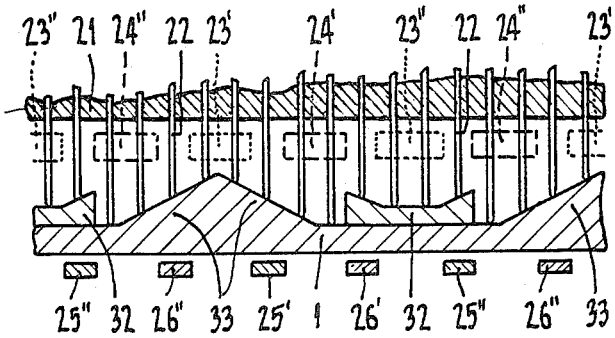
Figure 18C:
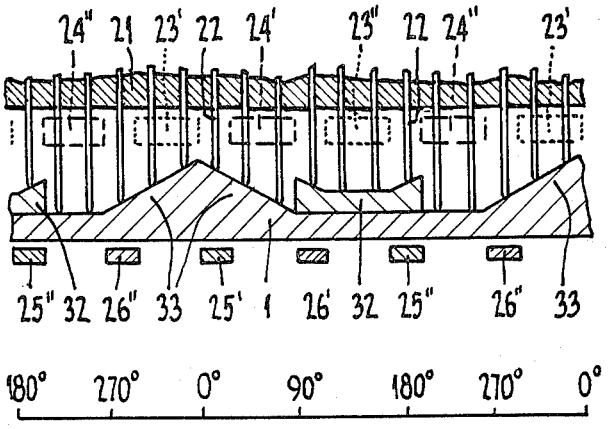

The movement of these zones is also shown in FIG. 18 but in respect to FIG. 18, the inlet and outlet zones are drawn in similar manner to previous figures for reasons of convenience but it is to be realized that those zones actually open through casing 1 rather than through the end plates 2 and 3. With respect to the fifth pump it is pointed out that the cavity comprises a cylindrical wall shaped to be of increasing radius between first and second angular positions indicated in FIG. 17, of decreasing radius between said second angular position and a third angular position and of increasing radius between said third angular position and a fourth angular position. The body 32 has an inner surface of increasing radius between the end of the body 32 adjacent said first position and an intermediate portion of said body and of decreasing radius between said intermediate portion and the end of said body adjacent said second position.

Figure 19A:
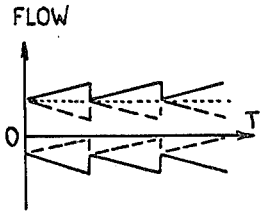
Figure 19B:
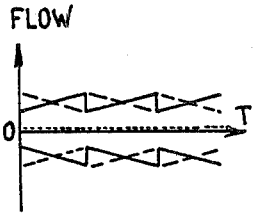
Figure 19C:
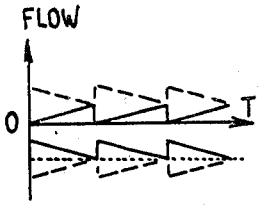

The developed views and displacement graphs of FIGS. 18 and 19 are similar to previously and show the pump to produce non-fluctuating flow. The rotor is also pressure balanced. The vane running surface 51 is not shown in FIG. 18 for reason of convenience of depiction.

Figure 17B:
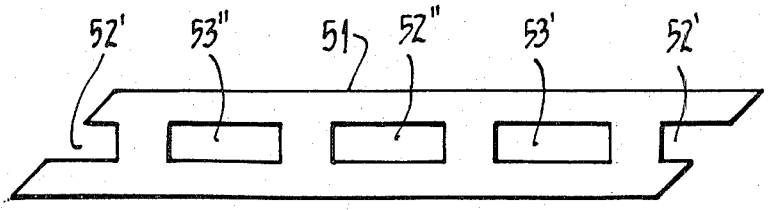

A developed view of the vane running surface is shown in FIG. 17*b* to show the ports 52', 52'', 53' and 53''.

It is particularly to be noted that the pump of FIG. 17 is capable of displacing fluid from the inlet to the outlet (positive displacement) but is also capable of displacing fluid in the opposite direction (negative displacement) such that the outlet actually acts as an inlet and the inlet acts as an outlet. In this respect positive displacement occurs in the FIG. 18(*a*) and FIG. 19(*a*) case, close to zero displacement occurs in the FIG. 18(*b*) and FIG. 19(*b*) case and negative displacement occurs in the FIG. 18(*c*) and FIG. 19(*c*) case.

The sixth pump shown in FIG. 20 is similar to the fifth pump but is of somewhat different arrangement. In this instance the pump is not capable of negative displacement and the inlet and outlet zones are provided by ports in one of the end plates. Said one of the end plates is angularly moveable about axis 31 to vary the angular position of the inlet and outlet zones, the pumping zones and body 32 (by means of a peg or like 99 inserted in hole 55). The pump of FIG. 20 has an inner cylindrical wall shaped to be of increasing radius between first and second angular positions marked in FIG. 20, of decreasing radius between said second angular position and a third angular position and of substantially constant radius between said third angular position and a fourth angular position. The body 32, has an inner surface of decreasing radius between the end of said body adjacent said third position and an intermediate portion of said body and of increasing radius between said portion and the end of said body adjacent said fourth position.

Figure 21A:
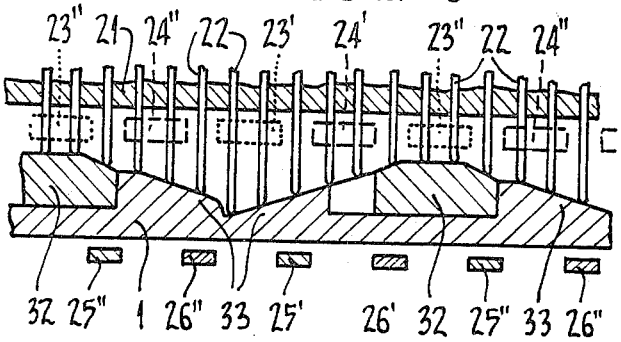
Figure 22A:
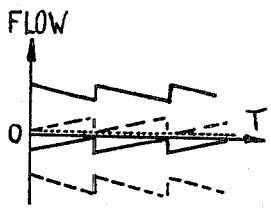
FIG. 22 is a graph showing the displacement (D) of the sixth pump with respect to time (T)
Figure 21B:
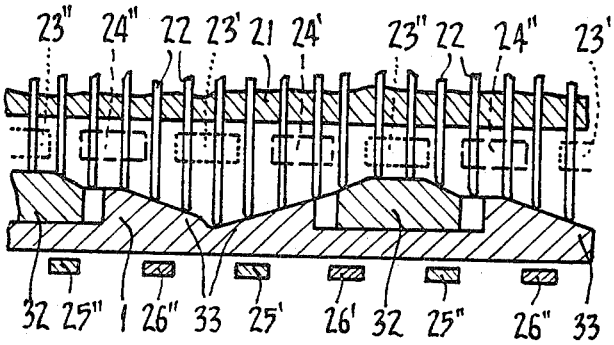
Figure 22B:
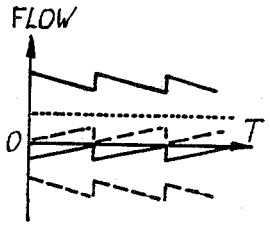
Figure 21C:
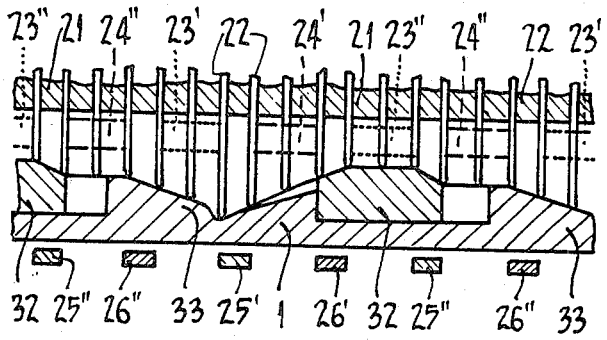
Figure 22C:
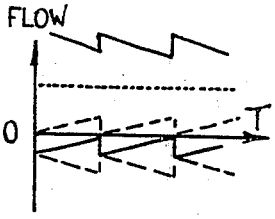

Developed views and displacement graphs are shown in FIGs. 21 and 22. In this instance non-fluctuating flow occurs and the rotor is pressure balanced.

The seventh pump shown in FIG. 23 is similar to the sixth pump and differs in that the cavity within the casing is slightly differently shaped, the vane running surface 51 has been omitted and, in lieu, a bridging member 41 has been provided to perform one function of the vane running surface 51, i.e. bridging between the body 32 and the spiral bodies 33.

Figure 23A:
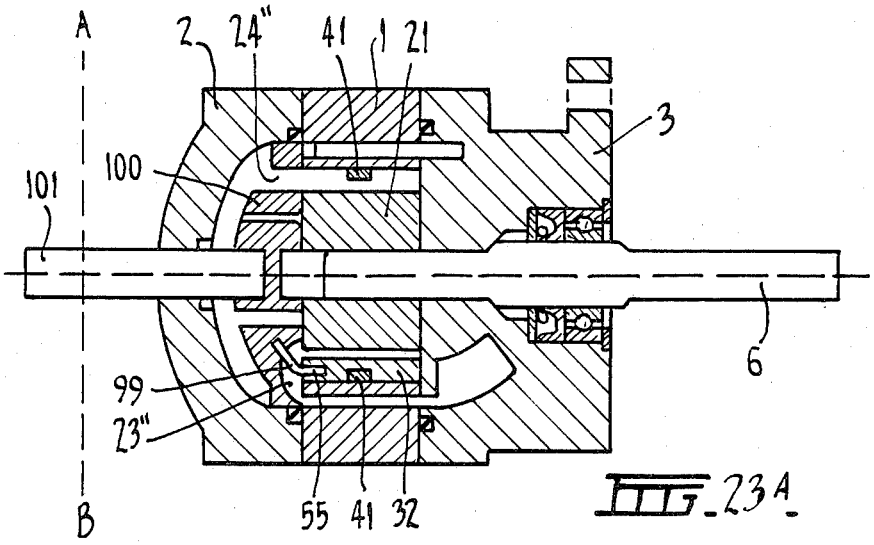
FIG. 23A is a cross-sectional view of the seventh pump.
Figure 26:
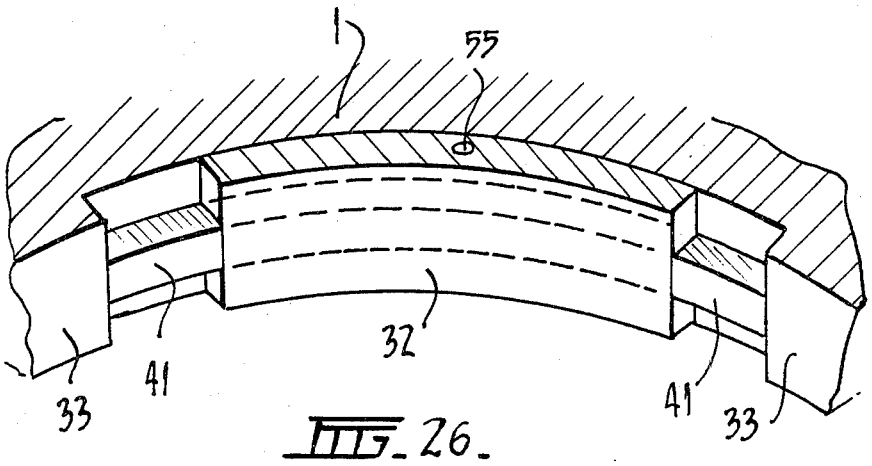
FIG. 26 is a perspective detail of part of the seventh pump.

The bridging member 41 and its relation to the body 32 is more clearly shown in FIG. 26. In this respect, the body 32 has, at its ends, a thickness substantially the same as the bridging member 41, is thicker intermediate its ends and has a channel formed in its radially outermost surface in which the bridging member 41 locates. Thus, the body 32 is made slideable along the bridging member 41. It should be noted that if the said bridging member does not fit the said channel perfectly fluid may enter one end of said channel and leak to the other end of said channel, however, this said other end of said channel will be in a zone of similar character to said one end and hence fluid leakage does not constitute a problem. The cross-sectional view of the seventh pump shown in FIG. 23A is a cross-section on the lines A and B in FIG. 23 and additionally discloses a pressure plate 100 which defines the inlet, outlet and pumping zone and which carries the peg or like 99 and a displacement control shaft 101 for rotating the pressure plate 100 to vary the displacement of the pump.

Figure 24A:
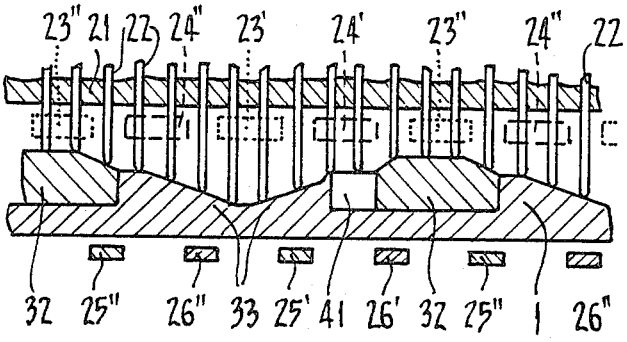
FIG. 24 is a developed view of the seventh pump in various adjustments.
Figure 25A:
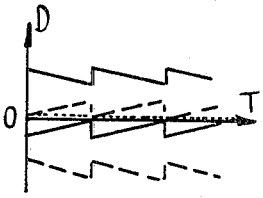
FIG. 25 is a graph showing the displacement (D) of the seventh pump with respect to time (T)
Figure 24B:
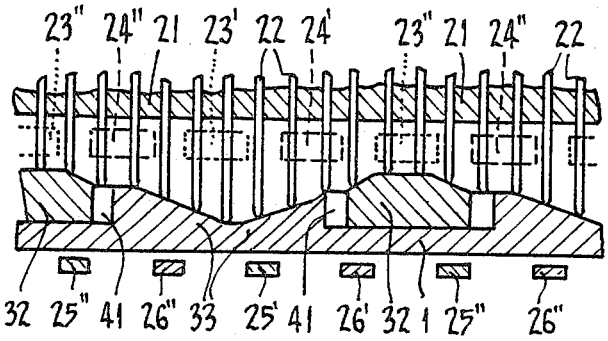
Figure 25B:
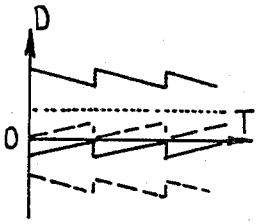
Figure 24C:
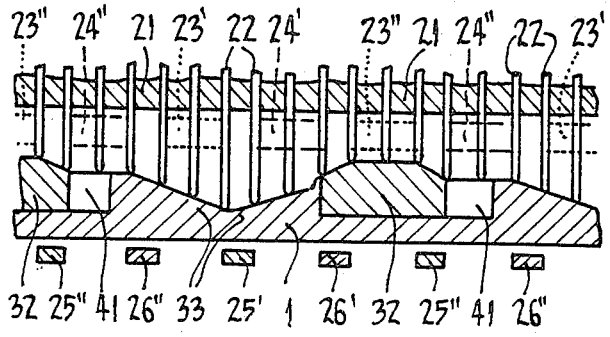
Figure 25C:
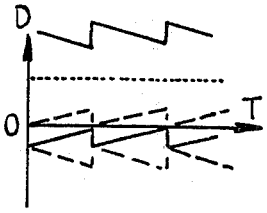
Figure 25C:
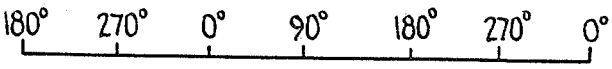

Developed views and displacement graphs are shown in FIGS. 24 and 25. In this instance non-fluctuating flow occurs and the rotor is pressure balanced.

Figure 27:
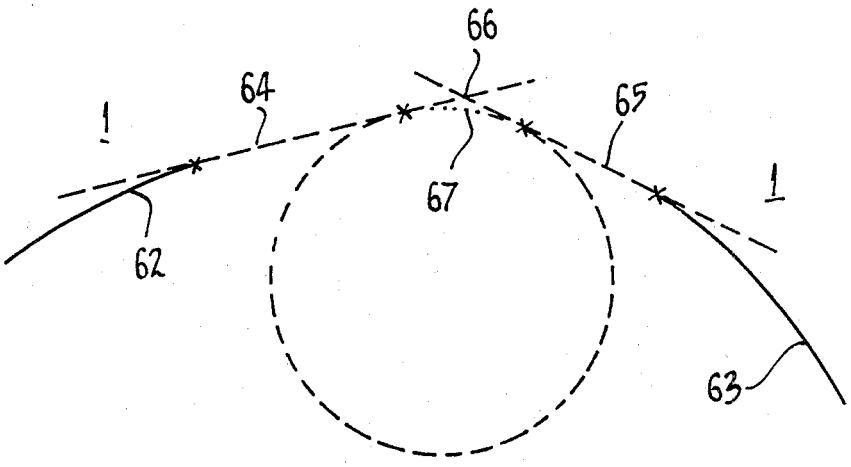
FIG. 27 is schematic detail of part of the seventh pump.

Reference will now be made to FIGS. 23 and 27. At the point 61 on the cavity wall within the casing 1 there is a substantial change in wall direction and leakage and wear at that point and other similar points can be significant. These problems can be largely overcome if the wall at such transition points is shaped as will now be described with respect to FIG. 27.

In FIG. 27 is shown two wall portions 62 and 63 with curves 64 and 65 shown by dashed lines extended from and intersecting tangentially with the said wall portions. These curves 64 and 65 may meet at a sharp intersection at 66. Such an intersection would be undesirable and, instead, the transition between the curves 64 and 65 follows an arc of a circle 67 tangential to the curves 64 and 65. By so doing a much smoother transition is obtained.

Vane pumps like the seventh pump should be designed so that all transitions between different wall portions are made similarly to that described.

In one modification one or more ported plates are disposed between the casing 1 and at least one of the end plates 2 and 3. Those ported plates are made angularly moveable to vary the position of various ones of the zones.

Modifications and adaptations may be made to the above described without departing from the spirit and scope of this invention which includes every novel feature and combination of features disclosed herein.

I claim:

1. A vane pump comprising vanes, a rotor carrying the vanes and which is rotatable about an axis, a housing, means defining a vane running path along which the vanes move, means defining two or more first regions, and two or more second regions of said vane running path to be of non-constant radius relative to said axis and which two or more first regions and two or more second regions vary the radius swept by the vanes as they pass along said two or more first regions and said two or more second regions, an inlet port communicating with two or more inlet zones, an outlet port communicating with two or more outlet zones, two or more forward pumping zones between adjacent inlet and outlet zones, two or more return pumping zones between adjacent outlet and inlet zones, means for varying the angular position of both ends of those pumping zones that are in the areas axially subtended by said two or more first regions in and relative to the area axially subtended by the respective first region whereby to vary the displacement of the pump, wherein both ends of those pumping zones that are in the areas axially subtended by said two or more second regions are fixed in and relative to the area axially subtended by the respective second region, wherein the ends of each of the pumping zones subtend an angle with respect to said axis substantially equal to the angle subtended with respect to said axis by two adjacent ones of said vanes, and wherein the non-constancy of the radius of said two or more first regions and said two or more second regions are such that fluctuating displacements from the pumping zones can be combined to produce a non-fluctuating net flow for all angular positions of said both ends of those pumping zones that are in the areas axially subtended by said two or more first regions in and relative to the area axially subtended by the respective first region.

2. A vane pump as claimed in claim 1, wherein said two or more first regions and said two or more second regions increase or decrease in radius at least substantially in accordance with the polar co-ordinate equation:

$$\gamma^2(\theta)=k_1\theta+k_2$$

where $\gamma$ is radius, $\theta$ is angle and $k_1$ and $k_2$ are parameters which are constant for each one of said two or more first regions and each one of said two or more second regions.

3. A vane pump as claimed in claim 1, wherein there are two or more outlet zones arranged in radial symmetry about said axis wherein the vanes are arranged in radial symmetry about said axis and the number of vanes is an integer multiple of the number of outlet zones whereby to obtain pressure balancing of the rotor with respect to said two or more outlet zones.

4. A vane pump as claimed in claim 1, wherein each of said two or more first regions has one of said two or more second regions which is so complementary thereto such that, and the non-constancy of radius of said two or more first regions and said two or more second regions are such that, fluctuating displacements from the pumping zones can be combined to produce a non-fluctuating net flow for all angular positions of said both ends of those pumping zones that are in the areas axially subtended by said two or more first regions in and relative to the area axially subtended by the respective first region.

5. A vane pump as claimed in claim 4, wherein said two or more first regions and said two or more second regions increase or decrease in radius at least substantially in accordance with the polar co-ordinate equation:

$$\gamma^2(\theta)=k_1\theta+k_2$$

where $\gamma$ is radius, $\theta$ is angle and $k_1$ and $k_2$ are parameters which are constant for each one of said two or more first regions and each one of said two or more second regions and wherein for each one of said two or more first regions there is one of said two or more second regions which is so complementary thereto for which the absolute value of $k_1$ is at least substantially the same.

6. A vane pump as claimed in claim 1 wherein each one of said two or more first regions and each one of said two or more second regions continuously increases or continuously decreases in radius.

7. A vane pump as claimed in claim 6 wherein there is one forward pumping zone in the area axially subtended by one of said two or more second regions of continuously increasing or continuously decreasing radius and one return pumping zone in the area subtended by one of said two or more first regions of, respectively, continuously increasing or continuously decreasing radius.

8. A vane pump as claimed in claim 6 wherein there is one forward pumping zone in the area axially subtended by one of said two or more second regions of continuously increasing or continuously decreasing radius and one forward pumping zone in the area axially subtended by one of said two or more first regions of, respectively, continuously decreasing or continuously increasing radius.

9. A vane pump as claimed in claim 6, wherein there is one return pumping zone in the area axially subtended by one of said two or more second regions of continuously increasing or continuously decreasing radius and one forward pumping zone in the area axially subtended by one of said two or more first regions of, respectively, continuously increasing or continuously decreasing radius.

10. A vane pump as claimed in claim 6, wherein there is one return pumping zone in the area axially subtended by one of said two or more second regions of continuously increasing or continuously decreasing radius and one return pumping zone in the area axially subtended by one of said two or more first regions of, respectively, continuously decreasing or continuously increasing radius.

11. A vane pump comprising a rotor carrying a plurality of vanes and capable of rotating about an axis, a housing for the rotor, a cavity within the housing having a cylindrical wall shaped to be of increasing radius to said axis between first and second angular positions, of decreasing radius to said axis between said second angular position and a third angular position and of increasing radius to said axis between said third angular position and a fourth angular position, a body located on said wall between said first and second angular positions and having an inner surface being part of an imaginary cylinder and which inner surface being of increasing radius to said axis between the end of said body adjacent said first position and an intermediate portion of said body and of decreasing radius to said axis between said intermediate portion and the end of said body adjacent said second position, inlet or outlet zones in the region of said intermediate position and in the region of said third position, outlet or inlet zones in the region of said first and second positions, and a running surface for said vanes bridging between said wall and said inner surface of said body and wherein said body is angularly moveable whereby to vary the displacement of the pump.

12. A vane pump as claimed in claim 11, wherein the fourth position and the first position are one and the same.

13. A vane pump as claimed in claim 11, wherein the portions of said wall and said body of increasing and decreasing radius increase and decrease at least substantially in accordance with the polar co-ordinate equation:

$$\gamma^2(\theta)=k_1\theta+k_2$$

where $\gamma$ is radius $\theta$ is angle $k_1$ and $k_2$ are constant.

14. A vane pump comprising a rotor carrying a plurality of vanes and capable of rotating about an axis, a housing for the rotor, a cavity within the housing having a cylindrical wall shaped to be of increasing radius to said axis between first and second angular positions, of decreasing radius to said axis between said second angular position and a third angular position and of substantially constant radius to said axis between said third angular position and a fourth angular position, a body located on said wall between said third and fourth angular positions and having an inner surface being part of an imaginary cylinder and which inner surface being of decreasing radius to said axis between the end of said body adjacent said third position and an intermediate portion of said body and of increasing radius to said axis between said intermediate portion and the end of said body adjacent said fourth position, a running surface for said vanes bridging between said wall and said inner surface of said body; inlet or outlet zones in the region of said second position and intermediate said third and fourth positions, outlet or inlet zones in the region of said third and fourth positions, and wherein said body is angularly moveable whereby to vary the displacement of the pump.

* * * * *